US006392359B1

(12) United States Patent
Stalions

(10) Patent No.: US 6,392,359 B1
(45) Date of Patent: May 21, 2002

(54) SYSTEM AND METHOD FOR REDUCING WAVELENGTH VARIATIONS BETWEEN LIGHT EMITTING DIODES

(75) Inventor: Drake C. Stalions, South Lyon, MI (US)

(73) Assignee: Gelcore, L.L.C., Valley View, OH (US)

( * ) Notice: Subject to any disclaimer, the term of this patent is extended or adjusted under 35 U.S.C. 154(b) by 0 days.

(21) Appl. No.: 09/765,503

(22) Filed: Jan. 22, 2001

(51) Int. Cl.[7] ..... H05B 37/02

(52) U.S. Cl. ..... 315/192; 315/193; 362/230; 362/231

(58) Field of Search ..... 315/312, 185 R, 315/192, 193, 179, 189, 190; 362/800, 230, 231

(56) References Cited

U.S. PATENT DOCUMENTS 4,160,934 A 7/1979 Kirsch
4,504,776 A 3/1985 Haville
4,864,216 A 9/1989 Kalata et al.
4,963,798 A * 10/1990 McDermott ..... 315/312
5,150,016 A 9/1992 Sawase et al.
5,907,569 A 5/1999 Glance et al.
5,938,321 A 8/1999 Bos et al.

* cited by examiner

*Primary Examiner*—David Vu
(74) *Attorney, Agent, or Firm*—Hanton & Williams

(57) ABSTRACT

A system and method for reducing wavelength variations between light emitting diodes (LEDs) is provided that determines an emission wavelength of each of a plurality of LEDs at a common drive current, and drives each of the plurality of LEDs with a respective operational drive current such that wavelength variations between the plurality of LEDs, when driven at the respective operational drive currents, is less than wavelength variations between the plurality of LEDs when driven at the common drive current. This system and method of the invention minimizes wavelength variations between LEDs, thereby allowing the use of more, and in some cases all, of the LEDs that are fabricated from a single semiconductor wafer, or multiple semiconductor wafers.

20 Claims, 5 Drawing Sheets

SYSTEM AND METHOD FOR REDUCING WAVELENGTH VARIATIONS BETWEEN LIGHT EMITTING DIODES

BACKGROUND OF THE INVENTION

This invention relates to light emitting diodes and, more particularly, to a system method for driving multiple light emitting diodes so as to reduce the wavelength variation between them.

Light emitting diodes (LEDs) are generally manufactured in batches using standard semiconductor fabrication techniques. A single semiconductor wafer will typically yield multiple LEDs. Although the fabrication process can be controlled to obtain LEDs that emit light at a specific color, there are generally significant variations in the output wavelengths of the LEDs when they are driven with a common drive current.

For example, a batch of LEDs can be designed to emit green light, however, one LED could emit light at 500 nm, while another LED could emit light at 506 nm. Even with LEDs that originate from a single wafer, the output wavelengths can vary significantly. LEDs that originate from different wafers can exhibit even greater wavelength variations.

In some LED applications, wavelength variations between the LEDs can be undesirable. For example, automobile manufacturers often create a vehicle's unique identity, in part, through the use of "theme" wavelength for the interior trim and illumination. This illumination can include backlighting of switches, instrument cluster backlighting, and general or specific illumination applications. If LEDs are used, the theme wavelength requirements generally dictate that their output light fall within a narrow range of wavelengths.

Because the output wavelengths of individual LEDs can vary by more than the amount of deviation allowable for certain applications, in many cases not ail of, the LEDs from a single semiconductor wafer can be used. Because some of the LEDs from a single wafer may be rejected for a particular application, the costs associated with utilizing LEDs is increased.

BRIEF SUMMARY OF THE INVENTION

In an exemplary embodiment of the invention, a method of driving a plurality of LEDs comprises the steps of: determining an emission wavelength of each of the plurality of LEDs at a common drive current; choosing a respective operational drive current for each of the plurality of LEDs such that wavelength variations between the plurality of LEDs, when driven at their respective operational drive currents, is less than wavelength variations between the plurality of LEDs when driven at the common drive current; and driving the plurality of LEDs with the respective operational drive currents.

The invention also provides a lighting system comprising: a plurality of LEDs that, when driven with a common drive current, collectively emit light with initial wavelength variations; and a drive circuit for driving the plurality of LEDs with respective operational drive currents, such that the plurality of LEDs collectively emit light with operational wavelength variations that are less than the initial wavelength variations.

The system and method of the invention minimizes wavelength variation between LEDs, thereby allowing the use of more, and in some cases all, of the LEDs that are fabricated from a single semiconductor wafer, or multiple semiconductor wafers. This reduces the costs associated with utilizing LEDs in lighting applications that require a narrow range of output wavelengths.

DETAILED DESCRIPTION OF THE INVENTION

Figure 1:
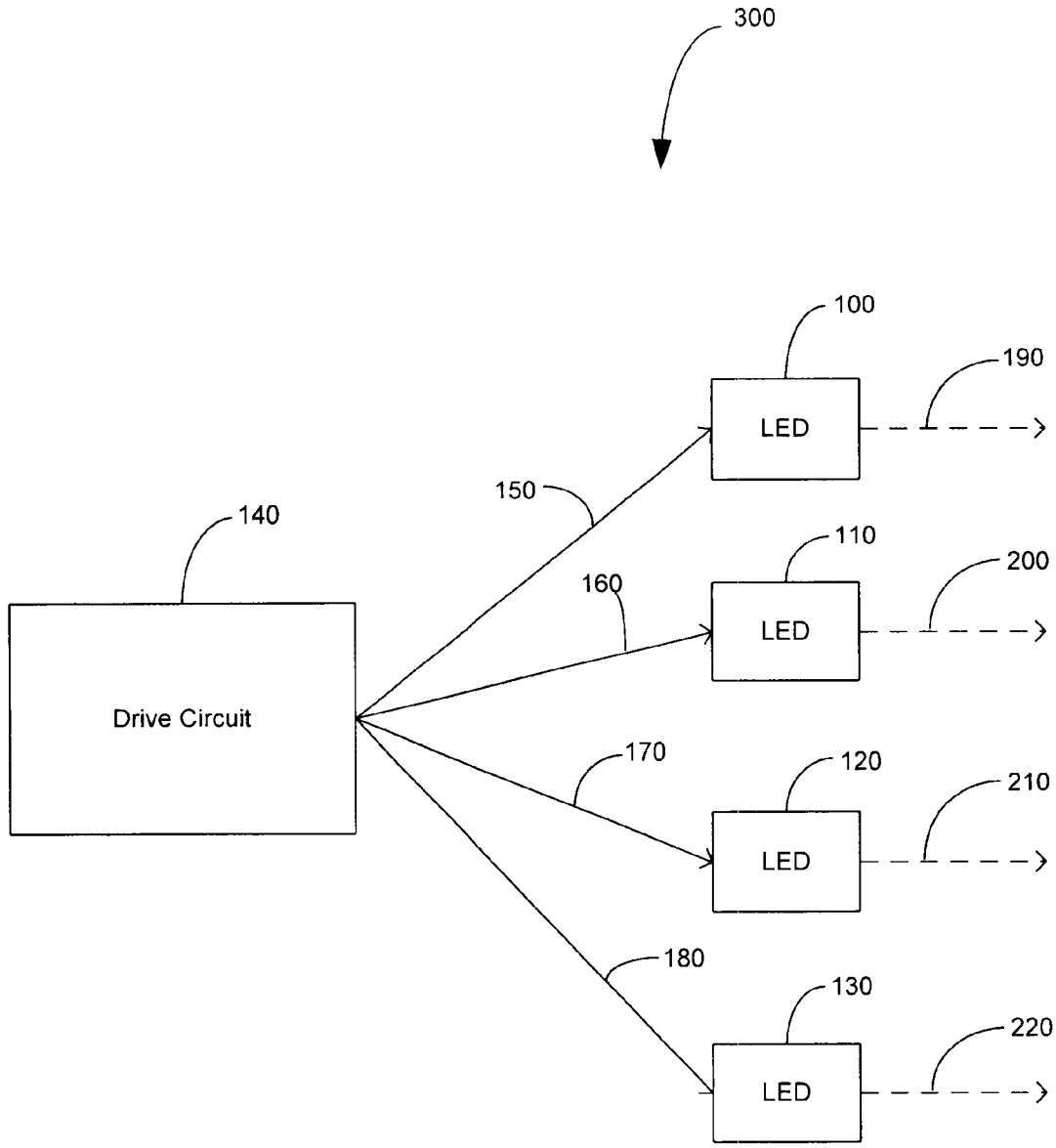
FIG. 1 is a block diagram of an LED lighting system, in accordance with one embodiment of the present invention.

FIG. 1 shows an LED lighting system 300 in accordance with one embodiment of the present invention. The system includes a plurality of LEDs, represented by LEDs 100, 110, 120 and 130. The system 300 also includes a drive circuit 140 that supplies drive currents to the LEDs 100–130 via signal lines 150, 160, 170 and 180, respectively.

When driven by the drive circuit 140, the LEDs 100, 110, 120 and 130 emit light 190, 200, 210 and 220 at respective wavelengths. The drive circuit 140 adjusts the operational drive current supplied to the LEDs 100–130 so that wavelength variations in the output light 190–220 are less than wavelength variations when the LEDs 100–130 are driven with a common drive current.

An aspect of the present invention is the recognition that the output wavelength of light emitted by an LED can be affected by the magnitude of the drive current applied to it, and applying this phenomena to a system and method that will allow more LEDs from a single wafer, or multiple wafers, to be utilized in lighting applications with a narrow range of permissible wavelengths.

In the system 300 of FIG. 1, the drive circuit 140 is adapted to drive each of the LEDs 100–130 with a respective operational drive current that will cause the wavelength variations in the output light 190–220 to be less than the wavelength variations that are present when the LEDs 100–130 are driven at a common drive current. The LED system 300 shown in FIG. 1 can be used in any lighting application in which control of wavelength variations between LEDs is desired. For example, the lighting system 300 of FIG. 1 could be used to implement indicator lights in an automobile interior, in which certain "theme" wavelengths are desired with very little wavelength variation.

To determine what operational drive currents to use for the LEDs 100–130, it must first be determined how the output wavelengths of the LEDs 100–130 vary as a function of changes in the operational drive current. As an illustrative example, assume that it is determined that the output wavelengths of LEDs 100–130 can be increased by approximately 2 nm by reducing the driving current by 5 mA, and that the output wavelength can be shortened by approximately 2 nm by increasing the drive current by 5 mA. Further, assume that, at a common drive current of 20 mA, LED 100 emits light 190 at 502 nm, LED 110 emits light 200 at 505 nm, LED 120 emits light 210 at 507 nm, and LED 130 emits light 220 at 508 nm.

If the lighting application calls for light that falls within the wavelength range of 504 nm–506 nm, then one possible solution is to drive LED 100 at 15 mA (making its output wavelength 504 nm), drive LED 110 at 20 mA (making its output wavelength 505 nm), drive LED 120 at 25 mA (making its output wavelength 505 nm), and drive LED 130 at 25 mA (making its output wavelength 506 nm).

Figure 2:
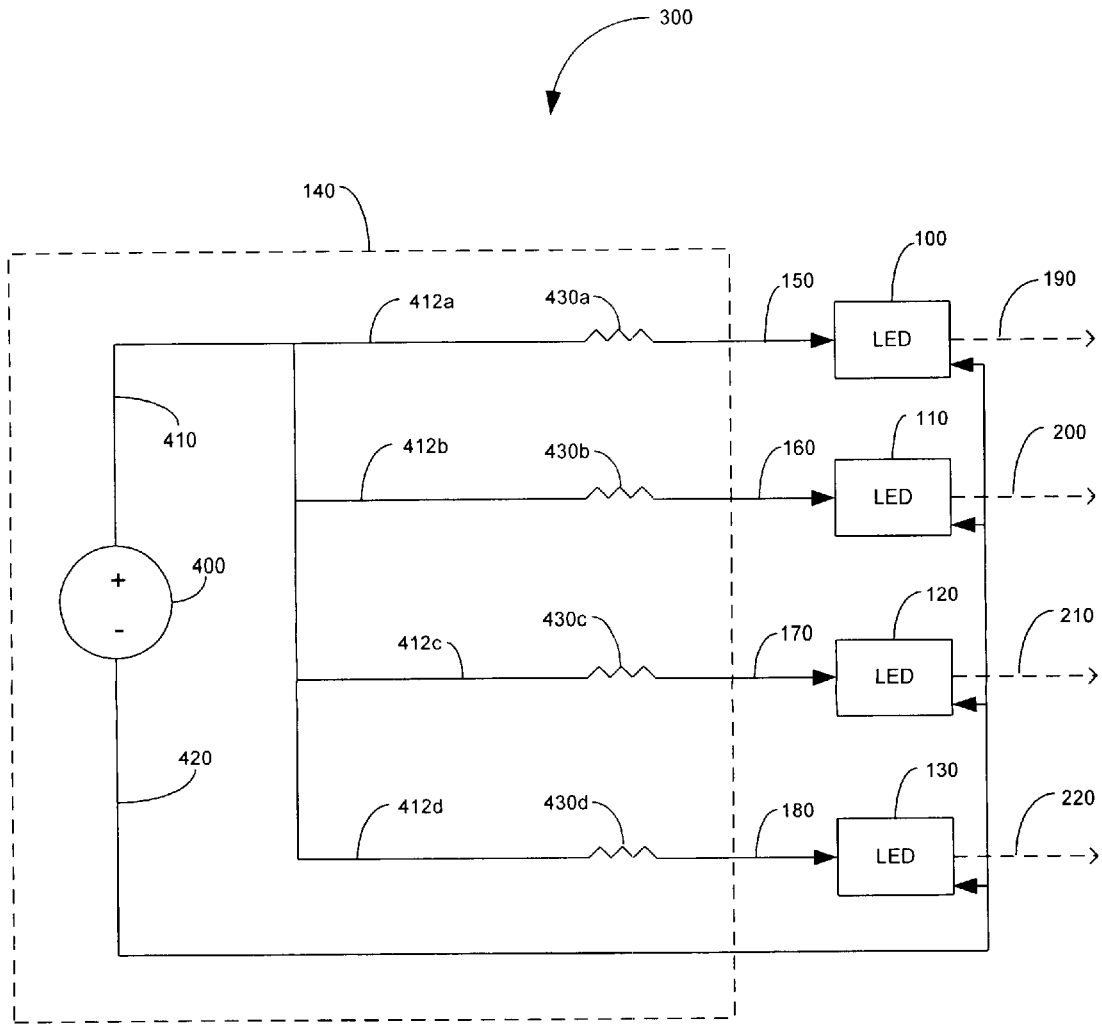
FIG. 2 is a block diagram of an LED lighting system, in accordance with another embodiment of the present invention.

In one embodiment, shown in FIG. 2, the drive circuit 140 comprises a single common voltage source 400 connected to individual resistors 430*a*–430*d* that are supplied for each of the LEDs 100–130. The values of the individual resistors 430*a*–430*d* are chosen to achieve the desired operational drive current at each LED, based on the single common voltage source 400. The positive terminal of the single common voltage source 400 is connected to each of the resistors 430*a*–430*d* via signal lines 410 and 412*a*–412*d*. The negative terminal of the single common voltage source 400 is connected to each of the LEDs 100–130 via signal line 420.

Driving the LEDs 100–130 with different operational drive currents will result in output light 190–220 of varying intensity. However, changes in intensity are generally considered insignificant when compared to variations in wavelength, particularly in the case of colors to which to human eye is most sensitive. Accordingly, the operational drive currents for the LEDs 100–130 are chosen so that the resulting variations in output light intensities between the LEDs 100–130 are within acceptable limits for the particular application. In many cases, choosing operational drive currents for the LEDs 100–130 that result in variations in output light intensities of less than 50 percent will be sufficient.

Figure 3:
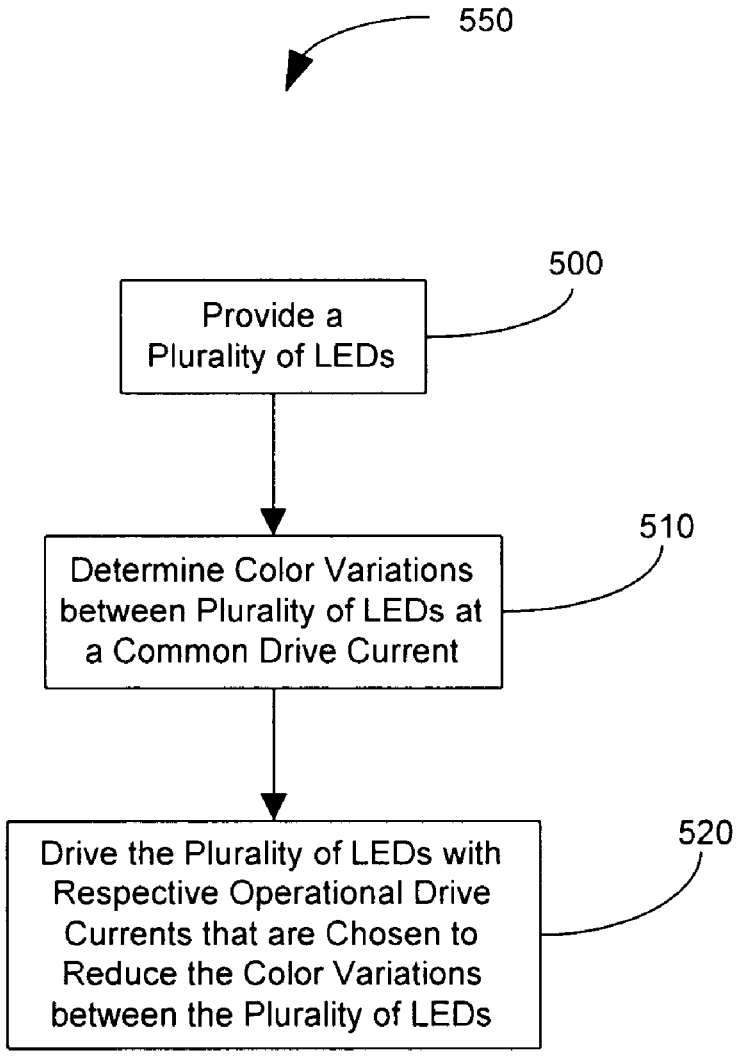
FIG. 3 is a flowchart of a method of generating light with a plurality of LEDs, in accordance with one embodiment of the present invention.

FIG. 3 is a flowchart of a method 550 of generating light with a plurality of LEDs, in accordance with one embodiment of the present invention. The method 550 starts at step 500, where a plurality of LEDs are provided. The LEDs could originate from a single semiconductor wafer and/or multiple semiconductor wafers.

At step 510, wavelength variations between the plurality of LEDs are determined at a common drive current in a manner similar to that discussed above. The method 550 then continues to step 520, where the plurality of LEDs are driven with respective operational drive currents that are chosen to reduce the wavelength variations between the plurality of LEDs to an amount that is less than the wavelength variations when the LEDs are driven at a common drive current. As explained above, the respective operational drive currents are preferably chosen so that variations in output light intensity between the plurality of LEDs, when driven at the respective operational drive currents, are less than 50 percent.

Figure 4:
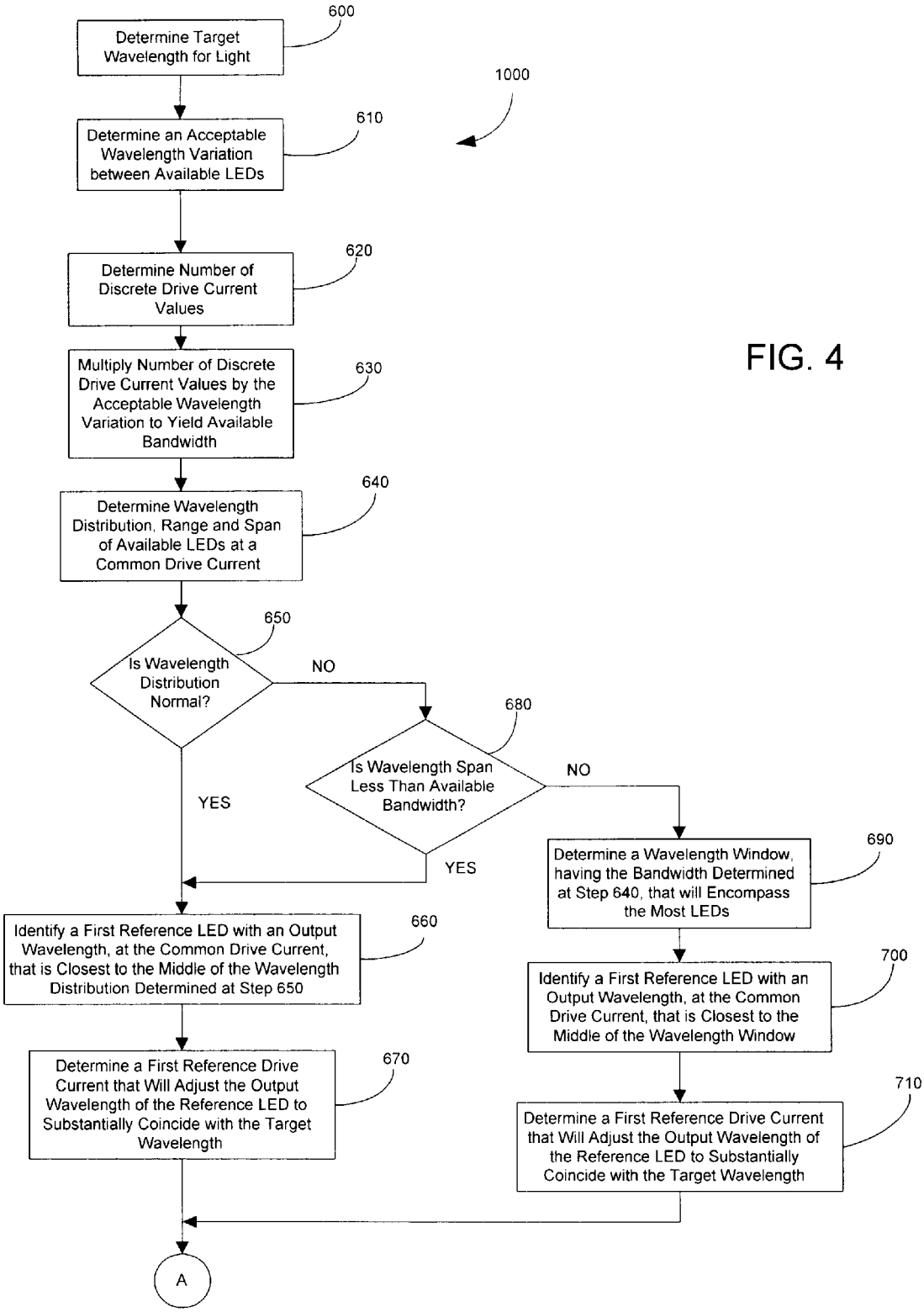
FIGS. 4 and 5 are flowcharts of a method of generating light with a plurality of LEDs, in accordance with another embodiment of the present invention.
Figure 5:
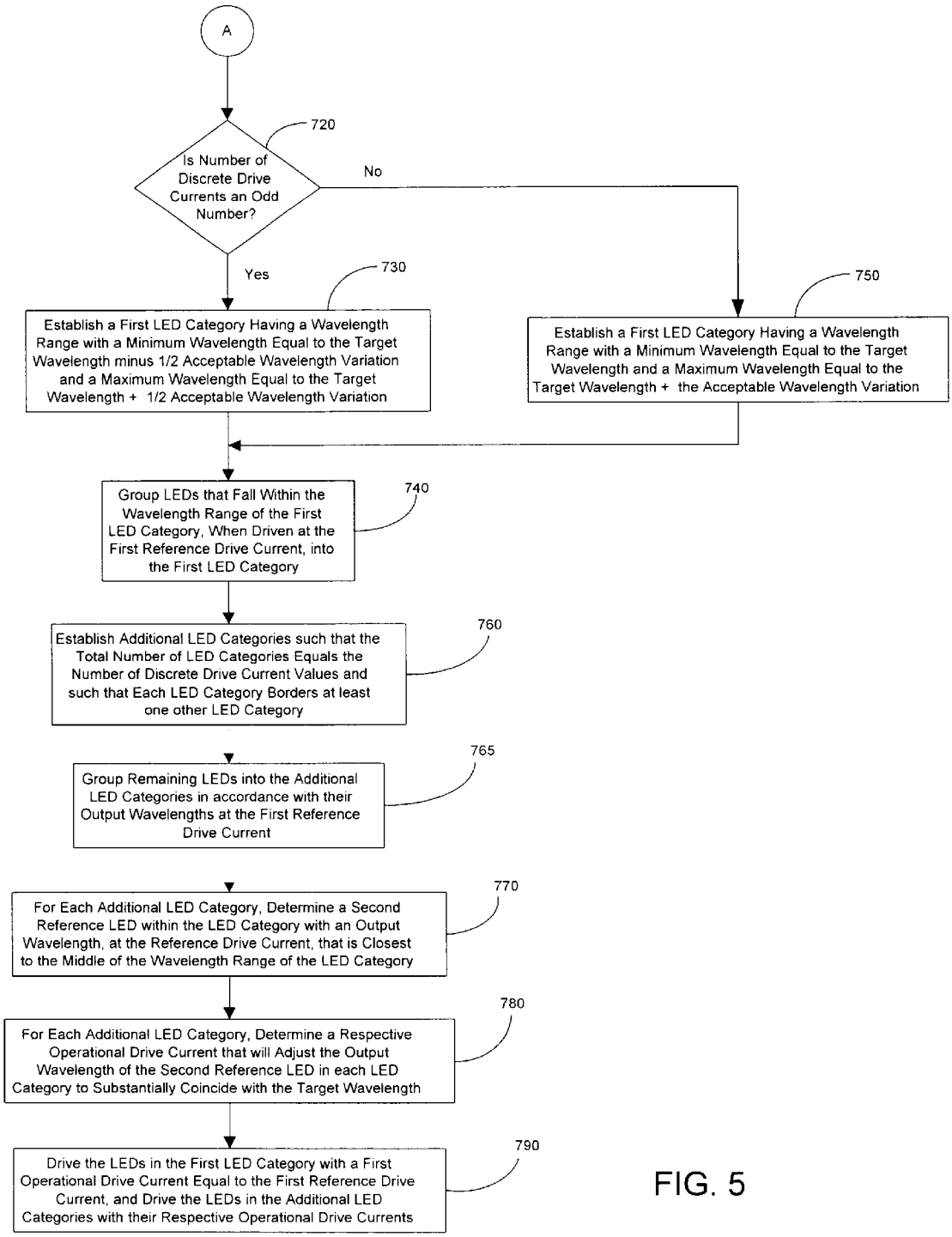

FIGS. 4 and 5 show a flowchart of a method 1000 of generating light with a plurality of LEDs, in accordance with another embodiment of the present invention. The method begins at step 600, where a target wavelength is determined for the particular lighting application that the LEDs will be used for. For example, an automotive interior application may call for light at 505 nm.

The method then continues to step 610, where an acceptable wavelength variation between the available LEDs is determined. The acceptable wavelength variation will vary depending on the lighting application. For example, an automotive interior application may call for light at a target wavelength of 505 nm, with a variation between LEDs of no more than 2 nm.

At step 620, the number of discrete drive current values that a user is willing to use to drive the LEDs is determined. The number of discrete drive current values available to drive the LEDs may be limited, for example, by the drive circuit being used. Next, at step 630, an available bandwidth is determined by multiplying the number of discrete drive current values, determined at step 620, by the acceptable color variation determined at step 610.

Next, at step 640, the wavelength distribution, range and span of available LEDs is determined at a common drive current (e.g., at a drive current of 20 mA). The "wavelength span" is defined as the difference in output wavelengths, at the common drive current, between the LED with the longest output wavelength and the LED with the shortest output wavelength. The method 1000 than continues to step 650, where it is determined whether the wavelength distribution, determined at step 640, corresponds to a normal distribution. If the wavelength distribution corresponds to a normal distribution, the method continues to step 660. Otherwise, the method jumps to step 680.

At step 660, an LED with an output wavelength, at the common drive current, that is closest to the middle of the wavelength distribution determined at step 640 is designated as a "reference LED". Next, at step 670, a first reference drive current is determined that will adjust the output wavelength of the reference LED to substantially coincide with the target wavelength. Control then continues to step 720 (FIG. 5).

At step 680, it is determined whether the wavelength span, determined at step 640, is less than the available bandwidth determined at step 630. If so, control jumps to step 660. Otherwise, control continues to step 690.

At step 690, a wavelength window is determined that has the same bandwidth as the available bandwidth, determined at step 630, and that will encompass the output wavelength of most of the available LEDs when they are driven at the common drive current. Next, at step 700, an LED with an output wavelength, at the common drive current, that is closest to the middle of the wavelength window is designated as the "reference LED".

The method then continues to step 710, where a first reference drive current is determined that will adjust the output wavelength of the reference LED to substantially coincide with the target wavelength. Control then continues to step 720 (FIG. 5).

At step 720, it is determined whether the number of discrete drive currents, determined at step 620, is an odd number. If so, controls continues to step 730. Otherwise, control jumps to step 750.

At step 730, a first category of LEDs is established having a wavelength range with a minimum wavelength equal to the target wavelength minus one-half of the acceptable wavelength variation, and a maximum wavelength equal to the target wavelength plus one-half of the acceptable wavelength variation. Control then continues to step 740. At step 750, a first LED category is established having a wavelength range with a minimum wavelength equal to the target wavelength, and a maximum wavelength equal to the target wavelength plus the acceptable wavelength variation. Control then jumps to step 740.

At step 740, LEDs with output wavelengths that fall within the wavelength range of the first LED category, when driven at the first reference drive current, are grouped into the first LED category. Next, at step 760, additional LED categories are established such that the total number of LED categories equals the number of discrete drive current values, and such that each LED category borders at least one other LED category.

For example, if the first LED category has a wavelength range with a minimum wavelength equal to the target wavelength minus one-half of the acceptable wavelength variation, and a maximum wavelength equal to the target wavelength plus one-half of the acceptable wavelength variation, the second LED category could have a wavelength range with a minimum wavelength equal to the maximum wavelength of the first category, and a maximum wavelength equal to the minimum wavelength plus the acceptable wavelength variation.

If the first LED category has a wavelength range with a minimum wavelength equal to the target wavelength, and a maximum wavelength equal to the target wavelength plus the acceptable wavelength variation, the second LED category could have a wavelength range with a maximum wavelength equal to the target wavelength, and a minimum wavelength equal to the maximum wavelength minus the acceptable wavelength variation.

At step 765, LEDs that were not grouped into the first LED category are grouped into the additional LED categories established at step 760, if their output wavelength at the first reference drive current fall within the wavelength range of any of the additional LED categories. Then, at step 770, an LED in each LED category with an output wavelength, at the first reference drive current, that is closest to the middle of the wavelength range of the respective category is designated as a "second reference LED". Next, at step 780, a respective operational drive current is determined, for each additional LED category, that will adjust the output wavelength of the second reference LED in each additional category to substantially coincide with the target wavelength. The method then proceeds to step 790, where the LEDs in the first LED category are driven with an operational drive current that is equal to the first reference drive current, and the additional LED categories are driven with the respective operational drive currents determined at step 780.

The following is an illustrative example of how the method 1000 of FIGS. 4 and 5 can be applied to a specific lighting application. At step 600, it is determined that the lighting application requires light with a target wavelength of 506 nm. At step 610, it is determined that a wavelength variation of no more than 6 nm is needed for the lighting application.

Then, at step 620, it is determined that a maximum of three discrete drive current values can be used to drive the available LEDs. Next, at step 630, the number of discrete drive current values (three) is multiplied by the acceptable wavelength variation (6 nm) to yield an available bandwidth of 18 nm. Then, at step 640, the available LEDs are driven at a common drive current (20 mA in this example) and their wavelength distribution, range and span, at that common drive current, is determined.

As discussed above, the wavelength span is defined as the difference in output wavelengths, at the common drive current, between the LED with the longest output wavelength and the LED with the shortest output wavelength. For this example, it is assumed that the available LEDs, when driven at the common drive current of 20 mA, emit light with a wavelength range of 500 nm–505 nm. This would make the wavelength span of the available LEDs when driven at the common drive current 5 nm (505 nm–500 nm).

At step 660, it is determined whether the wavelength distribution of the available LEDs, when driven at the common drive current, corresponds to a normal distribution. If so, an LED with an output wavelength, at the common drive current, that is closest to the middle of the wavelength distribution is designated as a reference LED. For this example, it is assumed that one of the available LEDs emits light at 503 nm when driven at the common drive current of 20 mA, which falls in the middle of the wavelength distribution of the available LEDs. The 503 nm LED is designated as a reference LED.

At step 670, a first reference drive current that will adjust the output wavelength of the 503 nm reference LED to substantially coincide with the target wavelength of 506 nm is determined. For this example, it is assumed that the output wavelength of the reference LED can be increased by 2 nm for every 5 mA decrease in drive current, and decreased by 2 nm for every 5 mA increase in drive current. Thus, decreasing the drive current from the common drive current of 20 mA to 12.5 mA will adjust the output wavelength of the reference LED to the target wavelength of 506 nm. Thus, in this example, the first reference drive current is 12.5 mA.

If the wavelength distribution of the available LEDs, when driven at the common drive current, is not a normal distribution, it is determined at step 680 whether the wavelength span of the available LEDs is less than the available bandwidth (calculated at step 630). If the wavelength span is less than the available bandwidth, the reference LED and first reference drive current are determined as discussed above in connection with a normal wavelength distribution.

If the wavelength span is not less than the available bandwidth, a "wavelength window" is determined that has the same bandwidth as the available bandwidth determined at step 630, and that will encompass most of the available LEDs. Specifically, the minimum and maximum wavelengths of the wavelength window are chosen so that the output wavelengths of as many of the available LEDs as possible, when driven at the common drive current of 27 mA, fall within the wavelength window. As an example, assume that the available LEDs have output wavelengths at the common drive current that range from 480 nm to 510 nm. This would correspond to a wavelength range of 30 nm. For this example, a wavelength window having a bandwidth of 18 nm, which is the same as the available bandwidth determined at step 630, will be defined with minimum and maximum wavelength values chosen to encompass as many of the available LEDs as possible. For this example, assume that a wavelength window with a minimum wavelength of 490 nm and a maximum wavelength of 508 nm will encompass the output wavelengths of most of the available LEDs.

Next, at step 700, an LED with an output wavelength, at the common drive current, that is closest to the middle of the wavelength window is designated as a reference LED. In this example, assume that an LED with an output wavelength at 499 nm at the common drive current exists. The 499 nm LED would be designated as the reference LED, because it falls in the middle of the wavelength window.

Next, at step 710, a first reference drive current that will adjust the output wavelength of the reference LED to substantially coincide with the target wavelength is determined. For this example, assume that a first reference drive current of 2.5 mA will adjust the output wavelength of the reference LED to coincide with the 506 nm target wavelength (a 5 mA decrease in drive current for every 2 nm increase in output wavelength).

Once the first reference drive current has been determined, using either of the methods discussed above, it is determined whether the number of available discrete drive currents is an odd number (step 720). If the number of discrete drive currents is an odd number, a first LED category is established (step 730) having a wavelength range with a minimum wavelength equal to the target wavelength minus one-half the acceptable wavelength variation and a maximum wavelength equal to the target wavelength plus one-half of the acceptable wavelength variation. In this example, there are three discrete drive currents (an odd number) that can be used. Thus, the first LED category will have a minimum wavelength equal to 503 nm (506 nm –3 nm), and a maximum wavelength of 509 nm (506 nm–3 nm).

At step 740, LEDs that fall within a wavelength range of the first LED category, when driven at the first reference drive current, are grouped into the first LED category. Next, at step 760, additional LED categories are established such the total number of LED categories equals the number of discrete current drive values, and such that each LED category borders at least one other LED category. In the present example, two additional LED categories are established for a total of three LED categories (there are three available discrete drive current values). In this example, the second LED category will have a minimum wavelength of 509 nm and a maximum wavelength of 515 nm and the third LED category will have a minimum wavelength of 497 nm and a maximum wavelength of 503 nm.

At step 765, LEDs that fall within the wavelength range of either of the two additional LED categories are grouped into that LED category. Then, at step 770, for each of the three categories, an LED with an output wavelength (at the reference drive current) that is closest to the middle of the wavelength range of its respective category is designated as a second reference LED. In this example, an LED with an output wavelength of 506 nm at the first reference drive current is designated as a second reference LED in the first LED category, an LED with an output wavelength of 512 nm at the first reference drive current is designated as the second reference LED in the second LED category, and an LED with an output wavelength of 500 nm at the first reference drive current is designated as the second reference LED in the third LED category.

Next, at step 780, respective operational drive currents are determined for each additional LED category that will adjust the output wavelength of the second reference LED in each additional LED category to substantially coincide with the target wavelength. The second reference LED in the first LED category has an output wavelength of 506 nm at the reference drive current. Thus, the operational drive current for the first LED category will be the same as the first reference drive current. The reference LED in the second LED category has an output wavelength of 512 nm at the first reference drive current. Assuming that the output wavelength can be shortened by approximately 2 nm by increasing the drive current by 5 mA, then the operational drive current for the second LED category will be 15 mA more than the first reference drive current. The second reference LED in the third LED category has an output wavelength of 500 nm at the first reference drive current. Thus, assuming the same output wavelength dependence on drive current, the operational drive current for the third LED category will be 15 mA less than the first reference drive current.

At step 790, the LEDs in the first LED category are driven with an operational drive current that is equal to the first reference drive current, and the LEDs in the second and third LED categories are driven with the respective operational drive currents determined at step 770.

Although the LEDs' wavelength dependence on drive current has been described as an inverse dependence in the examples discussed above, e.g., an increase in current will shorten the output wavelength and vice versa, it should be appreciated that some LEDs exhibit a direct wavelength dependence on changes in drive current, e.g., increasing the drive current will lengthen the wavelength and vice versa. The system and method of the present invention can be used with LEDs that exhibit a direct wavelength dependence and an inverse wavelength dependence on changes in drive current.

While the foregoing description includes many details and specificities, it should be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. A method of driving a plurality of light emitting diodes (LEDs), comprising the steps of:

determining an emission wavelength of each of the plurality of LEDs at a common drive current;

choosing a respective operational drive current for each of the plurality of LEDs, wherein a wavelength variation between the plurality of LEDs, when driven with their respective operational drive currents, is less than a wavelength variation between the plurality of LEDs when driven with the common drive current; and driving the plurality of LEDs with the respective operational drive currents.

2. The method of claim 1, wherein the respective operational drive currents are chosen to obtain a predetermined wavelength variation between the plurality of LEDs.

3. The method of claim 2, wherein the predetermined wavelength variation corresponds to a predetermined wavelength range.

4. The method of claim 1, wherein the step of choosing a respective operational drive current for each of the plurality of LEDs comprises the steps of:

determining a wavelength distribution of the plurality of LEDs at the common drive current; and determining, based on the wavelength distribution of the plurality of LEDs at the common drive current, the respective operational drive currents that will result in wavelength variations between the plurality of LEDs that are less than the wavelength variations between the plurality of LEDs at the common drive current.

5. The method of claim 1, wherein variations in output light intensity between the plurality of LEDs, when driven at the operational drive currents, are less than 50 percent.

6. A method of generating light, comprising the steps of:

providing a plurality of light emitting diodes (LEDs), wherein at least one of the plurality of LEDs has an emission wavelength that falls outside of an acceptable wavelength range when the plurality of LEDs are driven at a common drive current; and driving the plurality of LEDs with respective operational drive currents, wherein the operational drive current that drives the at least one of the plurality of LEDs is adjusted such that the emission wavelength of the at least one of the plurality of LEDs falls within the acceptable wavelength range.

7. The method of claim 6, wherein the step of driving each of the plurality of LEDs comprises the steps of:

identifying the at least one of the plurality of LEDs with an emission wavelength that falls outside of the acceptable wavelength range; and determining, based on the emission wavelength of the at least one of the plurality of LEDs at the common drive current, an operational drive current for the at least one of the plurality of LEDs that will adjust the emission wavelength of the at least one of the plurality of LEDs to fall within the acceptable wavelength range.

8. The method of claim 7, wherein the step of identifying the at least one of the plurality of LEDs comprises the steps of:

driving each of the plurality of LEDs with the common drive current; and determining an emission wavelength for each of the plurality of LEDs at the common drive current.

9. The method of claim 6, wherein variations in output light intensity between the plurality of LEDs, when driven at the operational drive currents, are less than 50 percent.

10. A method of generating light with a plurality of light emitting diodes (LEDs), comprising the steps of:

determining a target wavelength for the light;

determining an acceptable wavelength variation between the plurality of LEDs;

determining an available bandwidth based on a number of discrete drive currents available for driving the plurality of LEDs;

determining a wavelength distribution, wavelength range and wavelength span of the plurality of LEDs at a common drive current;

performing, if the wavelength distribution of the plurality of LEDs at the common drive current corresponds to a substantially normal distribution or if the wavelength span is less than the available bandwidth, the steps of:

determining a midpoint of the wavelength distribution, designating, as a first reference LED, an LED with an output wavelength that is closest to the midpoint of the wavelength distribution, when driven at the common drive current, and determining a first reference drive current that will adjust the output wavelength of the first reference LED to substantially coincide with the target wavelength;

performing, if the wavelength distribution of the plurality of LEDs at the common drive current does not correspond to a substantially normal distribution and the wavelength span is greater than or equal to the available bandwidth, the steps of:

determining a wavelength window having a bandwidth substantially equal to the available bandwidth, and having a wavelength range that encompasses output wavelengths of a maximum number of the plurality of LEDs, when the plurality of LEDs are driven at the common drive current, designating, as a first reference LED, an LED with an output wavelength that is closest to a midpoint of the wavelength window, when driven at the common drive current, and determining a first reference drive current that will adjust the output wavelength of the first reference LED to substantially coincide with the target wavelength;

establishing a first LED category having a wavelength span substantially equal to the acceptable wavelength variation;

grouping LEDs that fall within a wavelength range of the first LED category, when driven at a first operational drive current, into the first LED category;

establishing additional LED categories with respective wavelength spans substantially equal to the acceptable wavelength variation, wherein the number of additional LED categories established is equal to the number of discrete drive currents available, and wherein each additional LED category borders at least one other LED category;

grouping LEDs not grouped into the first LED category into the additional LED categories if their output wavelengths at the first reference drive current fall within a wavelength range of any of the additional categories;

for each additional LED category, determining a respective operational drive current that will adjust the output wavelength of the second reference LED to substantially coincide with the target wavelength;

driving the LEDs in the first LED category with the first operational drive current that is equal to the first reference drive current; and driving the LEDs in the additional categories with their respective operational drive currents.

11. The method of claim 10, wherein the number of discrete drive currents available is multiplied by the acceptable wavelength variation to determine the available bandwidth.

12. The method of claim 10, wherein the number of discrete drive currents available for driving the plurality of LEDs is an odd number, and wherein the first LED category established has a wavelength range with minimum and maximum wavelengths defined by the following relationships:

minimum wavelength=(target wavelength)−[½*(acceptable wavelength variation)];

and maximum wavelength=(target wavelength)+[½*(acceptable wavelength variation)].

13. The method of claim 10, wherein the number of discrete drive currents available for driving the plurality of LEDs is an even number, and wherein the first LED category established has a wavelength range with minimum and maximum wavelengths defined by the following relationships:

minimum wavelength=target wavelength;

and maximum wavelength=(minimum wavelength)+(acceptable wavelength variation).

14. The method of claim 10, wherein variations in output light intensity between the plurality of LEDs, when driven at the operational drive currents, are less than 50 percent.

15. A lighting system, comprising:

a plurality of light emitting diodes (LEDs) that, when driven with a common drive current, collectively emit light with an initial wavelength variation; and a drive circuit for driving the plurality of LEDs, wherein the drive circuit drives each of the plurality of LEDs with a respective operational drive current such that the plurality of LEDs collectively emit light with an operational wavelength variation that is less than the initial wavelength variation.

16. The system of claim 15, wherein the operational wavelength variation corresponds to an operational wavelength band.

17. The system of claim 15, wherein variations in output light intensity between the plurality of LEDs, when driven at the operational drive currents, are less than 50 percent.

18. A lighting system, comprising:

a plurality of light emitting diodes (LEDs), wherein at least one of the plurality of LEDs has an emission wavelength that falls outside of an acceptable wavelength range when the plurality of LEDs are driven at a common drive current; and a drive circuit for driving the plurality of LEDs with respective operational drive currents, wherein the operational drive current that drives the at least one of the plurality of LEDs is adjusted such that the emission wavelength of the at least one of the plurality of LEDs falls within the acceptable wavelength range.

19. The system of claim 18, wherein the acceptable wavelength range corresponds to an acceptable wavelength band.

20. The system of claim 18, wherein variations in output light intensity between the plurality of LEDs, when driven at the operational drive currents, are less than 50 percent.

* * * * *